US009232862B1

(12) United States Patent
Arch et al.

(10) Patent No.: US 9,232,862 B1
(45) Date of Patent: Jan. 12, 2016

(54) PORTABLE FOLDING TABLE

(71) Applicant: Michael Thomas Arch, Boerne, TX (US)

(72) Inventors: Michael Thomas Arch, Boerne, TX (US); Bruce Charles McLellan, Round Rock, TX (US)

(73) Assignee: Michael Thomas Arch, Boerne, TX (US)

( * ) Notice: Subject to any disclaimer, the term of this patent is extended or adjusted under 35 U.S.C. 154(b) by 0 days.

(21) Appl. No.: 14/631,741

(22) Filed: Feb. 25, 2015

(51) Int. Cl.
*A47B 3/00* (2006.01)
*A47D 5/00* (2006.01)

(52) U.S. Cl.
CPC ..... *A47D 5/006* (2013.01)

(58) Field of Classification Search
CPC ..... A47B 5/04; A47B 5/06; A47B 5/10; A47B 3/091; A47B 3/00; A47B 3/002; A47B 2003/0821
USPC ..... 108/38, 33, 34, 35, 36, 115, 129, 132, 108/162, 166, 167, 168, 171, 172, 173, 174, 108/169, 170
See application file for complete search history.

(56) References Cited

U.S. PATENT DOCUMENTS

| | | | | | |
|---|---|---|---|---|---|
| 1,543,372 | A | * | 6/1925 | Didricksen | 108/35 |
| 2,057,334 | A | * | 10/1936 | Hannum | 108/115 |
| 2,311,798 | A | * | 2/1943 | Weber | 108/35 |
| 2,777,138 | A | | 1/1957 | Gallagher | |
| 2,903,313 | A | * | 9/1959 | Block | 108/35 |
| 3,134,987 | A | | 6/1964 | Bertram | |
| 3,379,472 | A | * | 4/1968 | Hilfiker | 108/115 |
| 3,462,773 | A | | 8/1969 | Triplett | |
| 3,464,069 | A | | 9/1969 | Bien | |
| 3,967,330 | A | | 7/1976 | Zawadowsky | |
| 4,646,657 | A | * | 3/1987 | Zollinger | 108/115 |
| 4,887,536 | A | * | 12/1989 | Teichner | 108/35 |
| 4,926,758 | A | * | 5/1990 | Lilly et al. | 108/43 |
| 5,078,056 | A | * | 1/1992 | McCauley | 108/115 |
| 5,299,336 | A | | 4/1994 | Marteeny | |
| D367,771 | S | | 3/1996 | Julian | |
| 5,519,902 | A | | 5/1996 | Meade | |
| 6,139,567 | A | | 10/2000 | McCarty | |
| 6,192,809 | B1 | | 2/2001 | Riach | |
| 6,378,445 | B1 | | 4/2002 | Willard, Sr. | |
| 6,389,624 | B1 | | 5/2002 | Madole | |
| 6,581,228 | B1 | | 6/2003 | Boskovich | |
| 6,918,147 | B2 | | 7/2005 | Stackman | |
| 7,562,402 | B1 | | 7/2009 | Calloway | |
| 7,950,337 | B2 | * | 5/2011 | Chen | 108/115 |
| 2005/0252422 | A1 | * | 11/2005 | Sharpe et al. | 108/35 |
| 2008/0202390 | A1 | * | 8/2008 | Branch et al. | 108/35 |
| 2011/0285182 | A1 | | 11/2011 | Wilson | |

* cited by examiner

*Primary Examiner* — Jose V Chen
(74) *Attorney, Agent, or Firm* — Shane V. Cortesi

(57) ABSTRACT

A portable, folding table is described. The table includes a left panel, a middle panel, and a right panel and has an extended position in which the panels are substantially co-planar and a collapsed position in which the left and right panels fold between about 90 and about 180 degrees relative to the middle panel. The table optionally includes a handle attached to the front or rear side of the middle panel, legs attached to the left and right panels, and a motor to move the panels between the extended and collapsed positions. Optionally, the left or right panel includes a bottom flange that serves as a leg and further serves to hide the other panels when the table is in the collapsed position. The table is particularly suited for changing a child's diaper.

18 Claims, 5 Drawing Sheets

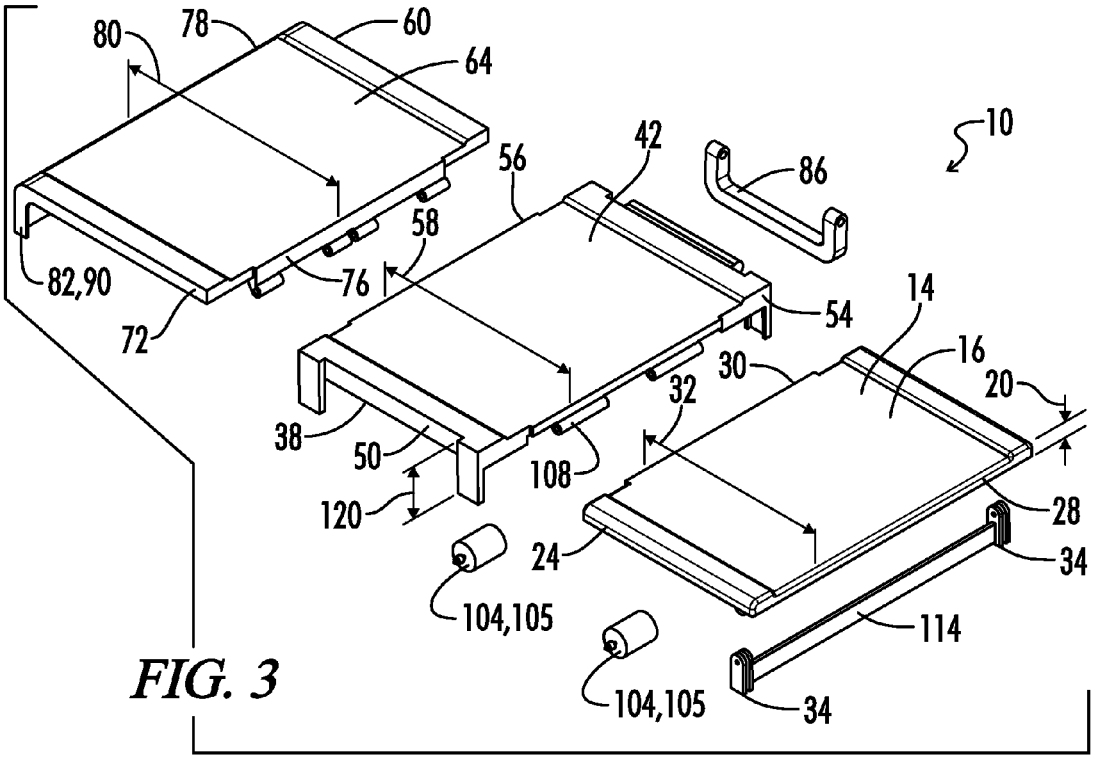
FIG. 3
FIG. 4
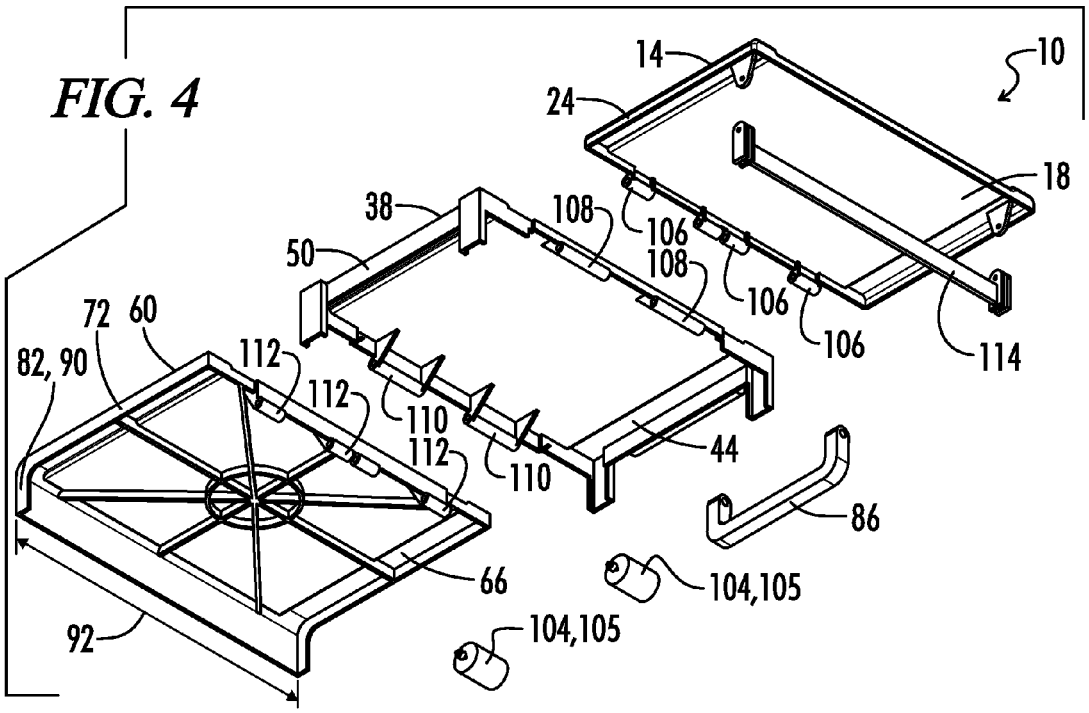

PORTABLE FOLDING TABLE

BACKGROUND

1. Technical Field

The present invention relates to portable folding tables, more specifically, portable folding tables that support infants and toddlers while an adult changes the infant or toddler's diaper.

2. Background of the Invention

Diaper changing tables are known in the art. For example, Koala Care Products (Centennial, Colo.) sells diaper changing tables (otherwise referred to as baby changing stations) that are commonly found in restaurant and store restrooms in the United States. Commonly, the tables are mounted to a wall in the restroom and fold from the wall when in use. Unfortunately, however, not all restrooms have diaper changing tables and adults often need to change diapers when a restroom with a diaper changing table is not nearby. Moreover, even if a diaper changing table is available, many adults would prefer to carry their own sanitary changing table for sanitary reasons. Adults often need to change diapers at inconvenient times and locations.

U.S. Pat. No. 6,918,147 describes a foldable portable diaper changing pad that is made up of a left panel, a middle panel, and a right panel. The pad is designed to be placed over a sink or supported by two chairs. Unfortunately, however, it is not always possible to find a supporting structure when an adult needs to change a child's diaper. In addition, the pad of the '147 patent appears as it would require the adult to use both of his/her hands to set up, which is problematic when the adult is trying to hold a baby.

U.S. Design Pat. No. 367,771 describes a portable diaper changing table. However, it is believed that the diaper changing table described therein would be overly bulky and would require the adult to use both of his/her hands to set up.

Thus, there is a need for portable, diaper changing tables that are not bulky to carry, are strong enough to support children and can be used in a variety of environments where wall-mounted changing tables are not available.

BRIEF SUMMARY

The present disclosure provides a portable changing table that is not bulky to carry, is strong enough to support a child weighing at least 40 pounds and can be operated with only one hand. Often times an adult caregiver needs to hold a baby in one hand and, thus, only has one free hand with which to move and maneuver the table. Thus, optionally, the changing table is motorized and can be completely opened while holding it with one hand. The adult's other hand is free to hold onto the baby, thus making this a much safer option for an adult that wants to use a portable changing table.

In some embodiments, the portable changing table includes:

a left panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface;

a middle panel pivotably attached to the left panel along a left pivot axis, the left pivot axis generally perpendicular to the left panel length and generally parallel to the left panel width, the middle panel comprising a top surface, a bottom surface, a thickness extending from the top surface to the bottom surface, a front side, a rear side, a width extending from the front side to the rear side, a left side, a right side, and a length extending from the left side to the right side; and a right panel pivotably attached to the middle panel along a right pivot axis, the right pivot axis generally perpendicular to the middle panel length and generally parallel to the middle panel width, the right panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface, wherein the portable changing table has an extended position in which the middle panel extends along the right side of the left panel and along the left side of the right panel and the top surface of the left panel is substantially co-planar with the top surface of the middle panel and the top surface of the right panel, wherein the portable changing table has a collapsed position in which the right panel bottom surface confronts the left panel top surface and the left panel bottom surface confronts the middle panel bottom surface, and wherein at least one of the front of the middle panel and rear of the middle panel comprises a handle.

Optionally, the handle is configured to pivot from a storage position in which the handle is substantially co-planar with the middle panel thickness to an extended position in which the handle is substantially perpendicular to the middle panel thickness. Optionally, the handle is configured to pivot along a handle pivot axis from the storage position to the extended position, the handle pivot axis generally parallel to the middle panel length. Optionally, the middle panel further comprises a handle recess configured to store the handle when the handle is in the storage position. Optionally, the portable changing table is configured to move from the extended position to the collapsed position by folding the right panel between about 90 degrees and about 180 degrees relative to the middle panel along the right pivot axis and folding the left panel between about 90 degrees and about 180 degrees relative to the middle panel along the left pivot axis. Optionally, the handle is located at the front of the middle panel, and the right panel further comprises a bottom flange forming the leg of the right panel, and the bottom flange has a bottom flange width generally parallel to the right panel width and a bottom flange height generally perpendicular to the right panel width, and the bottom flange height is at least as large as the combined thickness of the middle panel and the left panel (i.e., the bottom flange height is equal to or greater than the sum of the middle panel and the left panel thicknesses). Optionally, in the extended position, the middle panel extends substantially the entire width of the left panel and substantially the entire width of the right panel. Optionally, in the extended position, the table further comprises a left front gap located between the front of the right side of the left panel and the front of the left side of the middle panel, a left rear gap located between the rear of the right side of the left panel and the rear of the left side of the middle panel, a right front gap located between the front of the left side of the right panel and the front of the right side of the middle panel, and a right rear gap located between the rear of the left side of the right panel and the rear of the right side of the middle panel. Optionally, the portable changing table further comprises at least one motor configured to fold the left panel relative to the middle panel along the left pivot axis and to fold the right panel relative to the middle panel along the right pivot axis and at least one power source configured to power the at least one motor. Optionally, moving the handle is configured to control the motor. Optionally, the left panel right side comprises a left panel flange extending towards the middle panel, wherein the middle panel left side comprises a middle panel left flange extending towards the left panel, wherein the left panel flange is attached to the middle panel left flange along the left pivot axis to create a left hinge, wherein the right panel left side comprises a right panel flange extending towards the middle panel, wherein the middle panel right side comprises a middle panel right flange extending towards the right panel, and further wherein the right panel flange is attached to the middle panel right flange along the right pivot axis to create a right hinge. Optionally, the length of the left panel is substantially equal to the length of the middle panel and the length of the right panel. Optionally, the legs each have a height generally parallel to the thicknesses of the left, middle and right panels, and further wherein the height of each leg is from about 3 inches to about 3 feet. Optionally, the portable changing table has a length extending from the left panel left side to the right panel right side, and further wherein the length of the portable changing table is from about 3 feet to about 8 feet. Optionally, the top surface of the left panel right side confronts the top surface of the middle panel left side in the extended position, wherein the confrontation of the top surface of the left panel right side and the top surface of the middle panel left side in the extended position is configured to prevent the portable changing table from moving from the extended position to an over-extended position in which the top surface of the left panel moves towards the top surface of the middle panel, wherein the top surface of the right panel left side confronts the top surface of the middle panel right side in the extended position, and wherein the confrontation of the top surface of the right panel left side and the top surface of the middle panel right side in the extended position is configured to prevent the portable changing table from moving from the extended position to an over-extended position in which the top surface of the right panel moves towards the top surface of the middle panel. Optionally, at least one of the legs is configured to pivot from a storage position in which the leg is substantially co-planar relative to the bottom surface of the panel to which the leg is attached to an extended position in which the leg is substantially perpendicular relative to the bottom surface of the panel to which the leg is attached. Optionally, the left, middle and right panels are generally rectangular in shape.

Optionally, the portable changing table is used in a method that includes:

a) providing the portable changing table wherein the portable changing table is in the extended position; and b) placing a child on the top surfaces of at least one of the left panel, the middle panel and the right panel.

Optionally, the portable changing table is used in a method that includes:

a) providing the portable changing table wherein the portable changing table is in the extended position, wherein the handle is located at the front of the middle panel, wherein the right panel further comprises a bottom flange forming the leg of the right panel, wherein the bottom flange has a bottom flange width generally parallel to the left panel width and a bottom flange height generally perpendicular to the bottom flange width, and further wherein the bottom flange height is approximately equal to the combined thickness of the middle panel and the left panel;

b) folding the left panel between about 90 degrees and about 180 degrees relative to the middle panel along the left pivot axis; and c) after step b, folding the right panel between about 90 degrees and about 180 degrees relative to the middle panel along the right pivot axis.

In still further embodiments, the present disclosure provides a portable changing table that includes:

a left panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface;

a middle panel pivotably attached to the left panel along a left pivot axis, the left pivot axis generally perpendicular to the left panel length and generally parallel to the left panel width, the middle panel comprising a bottom surface, a top surface, a thickness extending from the top surface to the bottom surface, a front side, a rear side, a width extending from the front side to the rear side, a left side, a right side, and a length extending from the left side to the right side; and a right panel pivotably attached to the middle panel along a right pivot axis, the right pivot axis generally perpendicular to the middle panel length and generally parallel to the middle panel width, the right panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface, wherein the portable changing table has an extended position in which the middle panel extends along the right side of the left panel and along the left side of the right panel and the top surface of the left panel is substantially co-planar with the top surface of the middle panel and the top surface of the right panel, wherein the portable changing table has a collapsed position in which the right panel bottom surface confronts the left panel top surface and the left panel bottom surface confronts the middle panel bottom surface, and further wherein one of the right and the left panel further comprises a bottom flange forming the leg of the panel, wherein the bottom flange has a bottom flange width generally parallel to the panel's width and a bottom flange height generally perpendicular to the panel's width, and further wherein the bottom flange height is at least as large as the combined thickness of the other panels.

Optionally, the above embodiment includes a handle, a handle recess, at least one motor, gaps, panel flanges and hinges as previously described, and the panels are dimensioned and foldable as previously described.

In still further embodiments, the portable changing table includes:

a left panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface;

a middle panel pivotably attached to the left panel along a left pivot axis, the left pivot axis generally perpendicular to the left panel length and generally parallel to the left panel width, the middle panel comprising a top surface, a bottom surface, a thickness extending from the top surface to the bottom surface, a front side, a rear side, a width extending from the front side to the rear side, a left side, a right side, and a length extending from the left side to the right side; and a right panel pivotably attached to the middle panel along a right pivot axis, the right pivot axis generally perpendicular to the middle panel length and generally parallel to the middle panel width, the right panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface, wherein the portable changing table has an extended position in which the middle panel extends along the right side of the left panel and along the left side of the right panel and the top surface of the left panel is substantially co-planar with the top surface of the middle panel and the top surface of the right panel, wherein the portable changing table has a collapsed position in which the right panel bottom surface confronts the left panel top surface and the left panel bottom surface confronts the middle panel bottom surface, and further wherein the table further comprises at least one motor configured to fold the left panel relative to the middle panel along the left pivot axis and to fold the right panel relative to the middle panel along the right pivot axis and at least one power source configured to power the at least one motor.

Optionally, the above embodiment includes a handle, a handle recess, a bottom flange, panel flanges, gaps, and hinges as previously described, and the panels are dimensioned and foldable as previously described.

BRIEF DESCRIPTION OF THE DRAWINGS

in FIG. 1, the portable folding table is in the extended position.

FIG. 3 illustrates a rear, exploded perspective view of the portable folding table of FIG. 1.

FIG. 4 illustrates a bottom, exploded perspective view of the portable folding table of FIG. 1.

in FIG. 8, the portable changing table is partially folded.

in FIG. 9, the portable changing table is almost completely folded.

in FIG. 10, the portable changing table is in the collapsed position and the handle is in the extended position.

in FIG. 11, the portable changing table is in the collapsed position and the handle is in the storage position.

DETAILED DESCRIPTION

Figure 1:
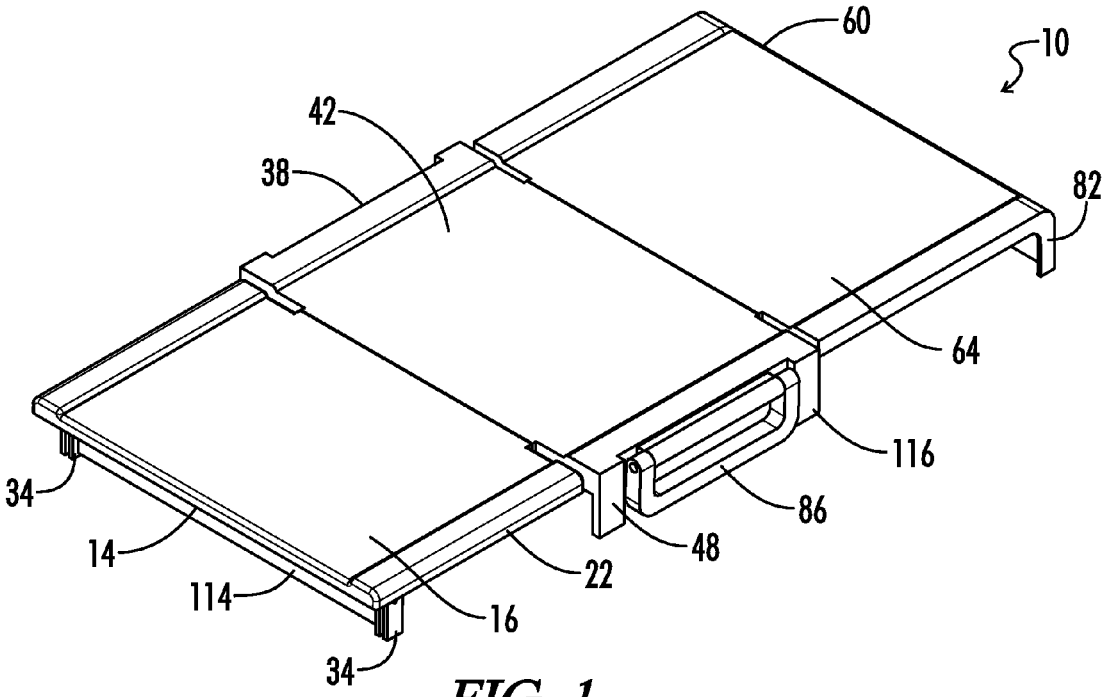
FIG. 1 illustrates a front, perspective view of a portable folding table of one embodiment of the present invention.
Figure 2:
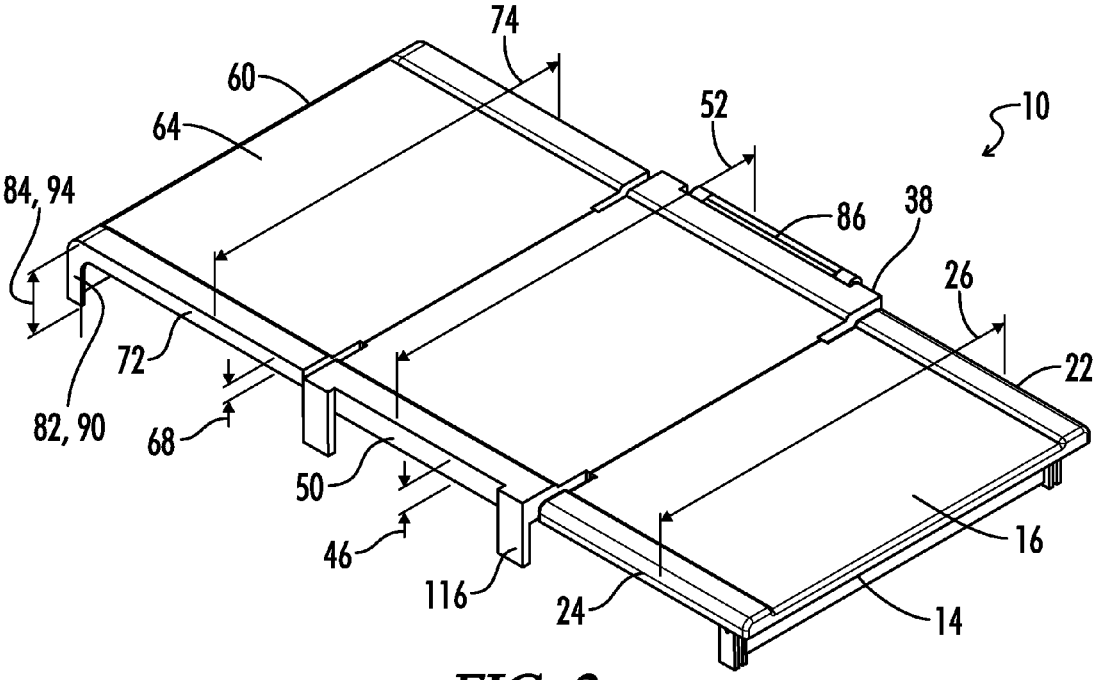
FIG. 2 illustrates a rear, perspective view of the portable folding table of FIG. 1.
Figure 5:
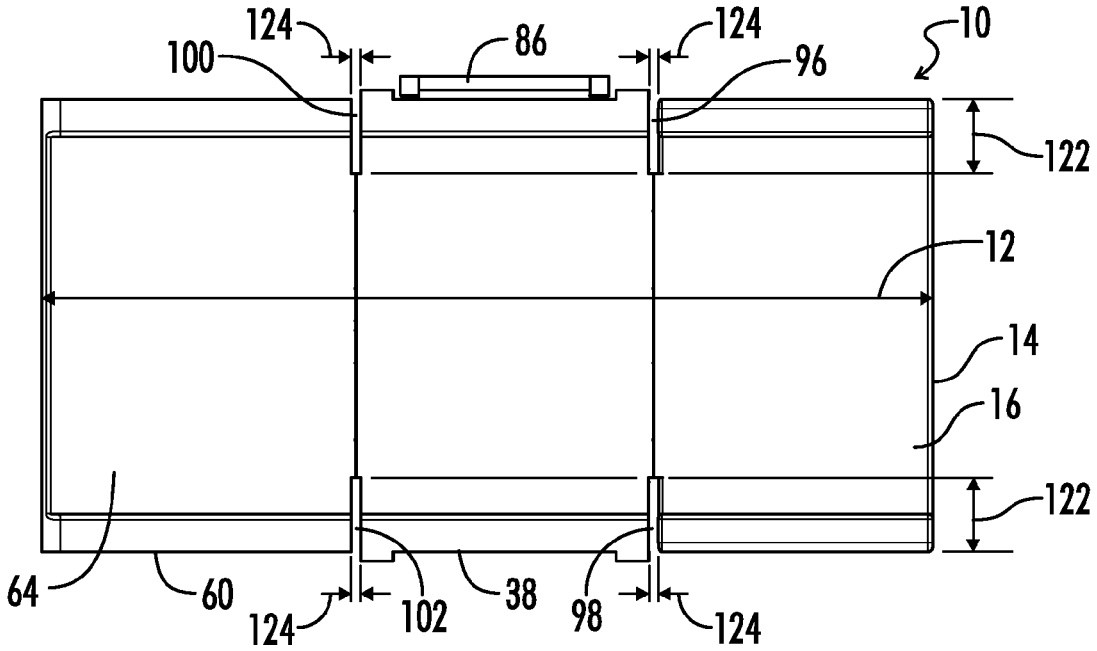
FIG. 5 illustrates a top, plan view of the portable folding table of FIG. 1.
Figure 6:
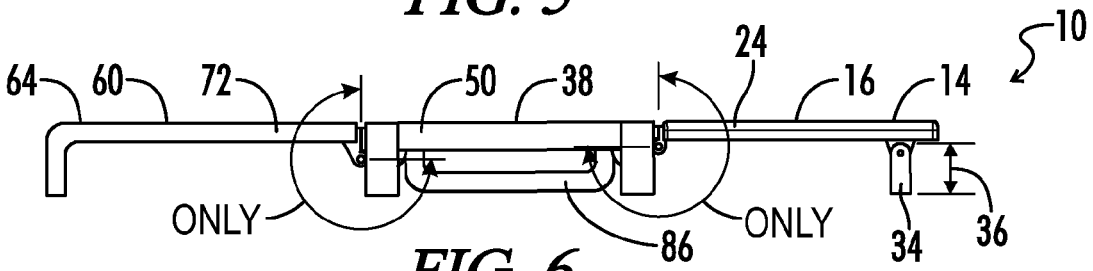
FIG. 6 illustrates a rear, elevation view of the portable folding table of FIG. 1.
Figure 7:
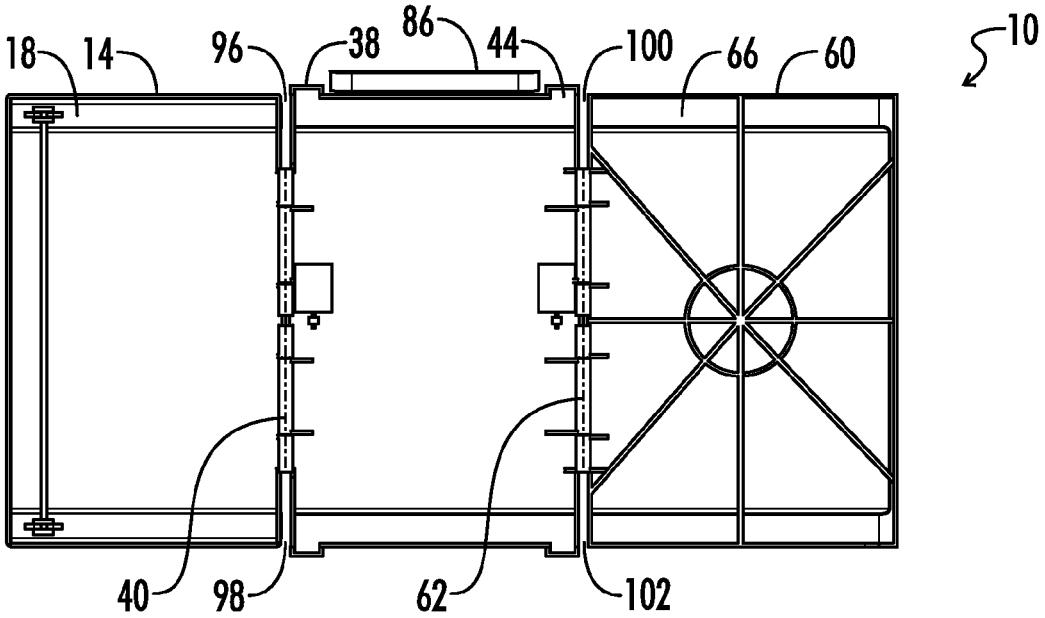
FIG. 7 illustrates a bottom, plan view of the portable folding table of FIG. 1.

With reference to FIGS. 1-12 the present disclosure provides a portable, folding table generally designated by the numeral 10. In the drawings, not all reference numbers are included in each drawing for the sake of clarity.

Referring to FIGS. 1-12, the present disclosure provides a portable changing table 10 comprising:

a left panel 14 comprising a top surface 16, a bottom surface 18, a thickness 20 extending from the top surface 16 to the bottom surface 18, a front side 22, a rear side 24, a width 26 extending from the front side 22 to the rear side 24, a left side 28, a right side 30, a length 32 extending from the left side 28 to the right side 30, and at least one leg 34 extending from the bottom surface 18;

a middle panel 38 pivotably attached to the left panel 14 along a left pivot axis 40, the left pivot axis 40 generally perpendicular to the left panel length 32 and generally parallel to the left panel width 26, the middle panel 38 comprising a bottom surface 44, a top surface 42, a thickness 46 extending from the top surface 42 to the bottom surface 44, a front side 48, a rear side 50, a width 52 extending from the front side 48 to the rear side 50, a left side 54, a right side 56, and a length 58 extending from the left side 54 to the right side 56; and a right panel 60 pivotably attached to the middle panel 38 along a right pivot axis 62, the right pivot axis 62 generally perpendicular to the middle panel length 58 and generally parallel to the middle panel width 52, the right panel 60 comprising a top surface 64, a bottom surface 66, a thickness 68 extending from the top surface 64 to the bottom surface 66, a front side 70, a rear side 72, a width 74 extending from the front side 70 to the rear side 72, a left side 76, a right side 78, a length 80 extending from the left side 76 to the right side 78, and at least one leg 82 extending from the bottom surface 66.

The portable changing table 10 has an extended position in which the middle panel 38 extends along the right side 30 of the left panel 14 and along the left side 76 of the right panel 60 and the top surface 16 of the left panel 14 is substantially co-planar with the top surface 42 of the middle panel 38 and the top surface 64 of the right panel 60, and a collapsed position in which the right panel bottom surface 66 confronts the left panel top surface 16 and the left panel bottom surface 18 confronts the middle panel bottom surface 44. Unless otherwise noted, features of the table 10 recited herein refer to the table 10 in the extended position.

Optionally, the middle panel 38, the left panel 14, and the right panel 60 are comprised of plastic. Optionally, at least one of the front 48 of the middle panel 38 and rear 50 of the middle panel 38 comprises a handle 86. Optionally, the handle 86 is configured to pivot from a storage position in which the handle 86 is substantially co-planar with the middle panel thickness 46 to an extended position in which the handle 86 is substantially perpendicular to the middle panel thickness 46. Optionally, the handle 86 is configured to pivot along a handle pivot axis 88 from the storage position to the extended position, the handle pivot axis 88 generally parallel to the middle panel length 58. Optionally, the middle panel 38 further comprises a handle recess 118 configured to store the handle 86 when the handle 86 is in the storage position.

Optionally, the portable changing table 10 is configured to move from the extended position to the collapsed position by folding the right panel 60 between about 90 degrees and about 180 degrees relative to the middle panel 38 along the right pivot axis 62 and folding the left panel 14 between about 90 degrees and about 180 degrees relative to the middle panel 38 along the left pivot axis 40.

Optionally, the handle 86 is located at the front 48 of the middle panel 38, the right panel 60 further comprises a bottom flange 90 forming the leg 82 of the right panel 60. The bottom flange 90 has a bottom flange width 92 generally parallel to the right panel width 74 and a bottom flange height 94 generally perpendicular to the right panel width 74, and the bottom flange height 94 is at least as large as the combined thickness of the middle panel and the left panel (i.e., the sum of thicknesses 20 and 46) so that the bottom flange 90 hides the middle and left panels 38 and 14 when the table 10 is in the collapsed position.

Optionally, in the extended position, the middle panel 38 extends substantially the entire width 26 of the left panel 14 and substantially the entire width 74 of the right panel 60. Optionally, in the extended position, the table 10 further comprises a left front gap 96 located between the front 22 of the right side 30 of the left panel 14 and the front 48 of the left side 54 of the middle panel 38, a left rear gap 98 located between the rear 24 of the right side 30 of the left panel 14 and the rear 50 of the left side 54 of the middle panel 38, a right front gap 100 located between the front 70 of the left side 76 of the right panel 60 and the front 48 of the right side 56 of the middle panel 38, and a right rear gap 102 located between the rear 72 of the left side 76 of the right panel 60 and the rear 50 of the right side 56 of the middle panel 38. The purpose of the gaps 98, 100, 102 and 104 is child safety, more particularly, to prevent the child's fingers from getting caught in the table 10 while the table 10 is folded and the child is located on the top surfaces 16, 42, and 64 of the left 14, middle 38, and/or right panels 60. Optionally, each of the gaps 96, 98, 100, and 102 has a length 124 of between about 1 inch to about 8 inches (more preferably between about 1.5 inches and about 8 inches) that is generally parallel to the panel lengths 32, 58, and 80 and a width 122 of between about 1 inch to about 12 inches (more preferably between about 1.5 inches and about 8 inches) that is generally parallel to the panel widths 26, 52 and 74.

Optionally, the portable changing table 10 further comprises at least one motor 104 configured to fold the left panel 14 relative to the middle panel 38 along the left pivot axis 40 and to fold the right panel 60 relative to the middle panel 38 along the right pivot axis 62 and at least one power source 105 (e.g., a battery) configured to power the at least one motor 104. Optionally, the portable changing table 10 comprises two motors 104, the first motor 104 located adjacent the intersection of the right side 30 of the left panel bottom surface 18 and the left side 54 of the middle panel bottom surface 44 and the second motor 104 located adjacent to the intersection of the right side 56 of the middle panel bottom surface 44 and the left side 76 of the right panel bottom surface 66. Optionally, moving the handle 86 from the storage position to the extended position is configured to actuate the at least one motor 104 and moving the handle 86 from the extended position to the storage position is configured to stop the motor 104 (i.e., the handle 86 acts as a control). In other embodiments, the table 10 use a spring or elastic mechanism (instead of a motor) that is optionally actuated by the handle 86 to move the table 10 from the collapsed position to the extended position. Whatever mechanism is used to move the table 10 from the collapsed position to the extended position, the power of the mechanism should be selected with child safety in mind—i.e., not too much torque to create a hazard for a child's fingers to be caught in the table 10 when the panels 14, 38, and 60 fold or unfold.

Optionally, the left panel right side 30 comprises a left panel flange 106 extending towards the middle panel 38, wherein the middle panel left side 54 comprises a middle panel left flange 108 extending towards the left panel 14, wherein the left panel flange 106 is attached to the middle panel left flange 108 along the left pivot axis 40 to create a left hinge, wherein the right panel left side 76 comprises a right panel flange 112 extending towards the middle panel 38, wherein the middle panel right side 56 comprises a middle panel right flange 110 extending towards the right panel 60, and further wherein the right panel flange 112 is attached to the middle panel right flange 110 along the right pivot axis 62 to create a right hinge.

Optionally, the length 32 of the left panel 14 is substantially equal to the length 58 of the middle panel 38 and the length 80 of the right panel 60.

Optionally, the middle panel 38 may also include legs 116 extending from the bottom surface 44 of the middle panel 38. Optionally, the legs 34, 82 and 116 each have a height 36, 84 and 120 generally parallel to the thicknesses 20, 46 and 68 of the left 14, middle 38 and right panels 60, and further wherein the height 36, 84 and 120 of each leg 34, 82 and 116 is from about 3 inches to about 3 feet. Optionally, the legs 34, 82 and 116 are approximately the same height. Optionally, the left legs 34 are a single piece connected by a bar 114, as seen in FIGS. 1, 3, 4, and 8. Optionally, the left legs 34 are configured to pivot from a storage position in which the legs 34 are substantially co-planar relative to the bottom surface 18 of the left panel 14 to an extended position in which the legs 34 are substantially perpendicular relative to the bottom surface 18 of the left panel 14.

Optionally, the portable changing table 10 has a length 12 extending from the left panel left side 28 to the right panel right side 78, and the length 12 of the portable changing table 10 is from about 3 feet to about 8 feet.

Optionally, the top surface 16 of the left panel right side 30 confronts the top surface 42 of the middle panel left side 54 in the extended position, the confrontation of the top surface 16 of the left panel right side 30 and the top surface 16 of the middle panel left side 54 in the extended position is configured to prevent the portable changing table 10 from moving from the extended position to an over-extended position in which the top surface 16 of the left panel 14 moves towards the top surface 42 of the middle panel 38, the top surface 64 of the right panel left side 76 confronts the top surface 42 of the middle panel right side 56 in the extended position, and the confrontation of the top surface 64 of the right panel left side 76 and the top surface 42 of the middle panel right side 56 in the extended position is configured to prevent the portable changing table 10 from moving from the extended position to an over-extended position in which the top surface 64 of the right panel 60 moves towards the top surface 42 of the middle panel 38. See FIG. 6 (rotational arrows).

Optionally, the left 14, middle 38 and right panels 60 are generally rectangular in shape.

Optionally, the portable changing table 10 is used in a method that includes:

a) providing the portable changing table 10 wherein the portable changing table 10 is in the extended position; and b) placing a child on the top surfaces 16, 42, and 64 of at least one of the left panel 14, the middle panel 38 and the right panel 60.

Optionally, the child is laid across the left 14, middle 38 and right panels 60 so that the longitudinal axis of the child is generally parallel to the length 12 of the table 10.

Figure 8:
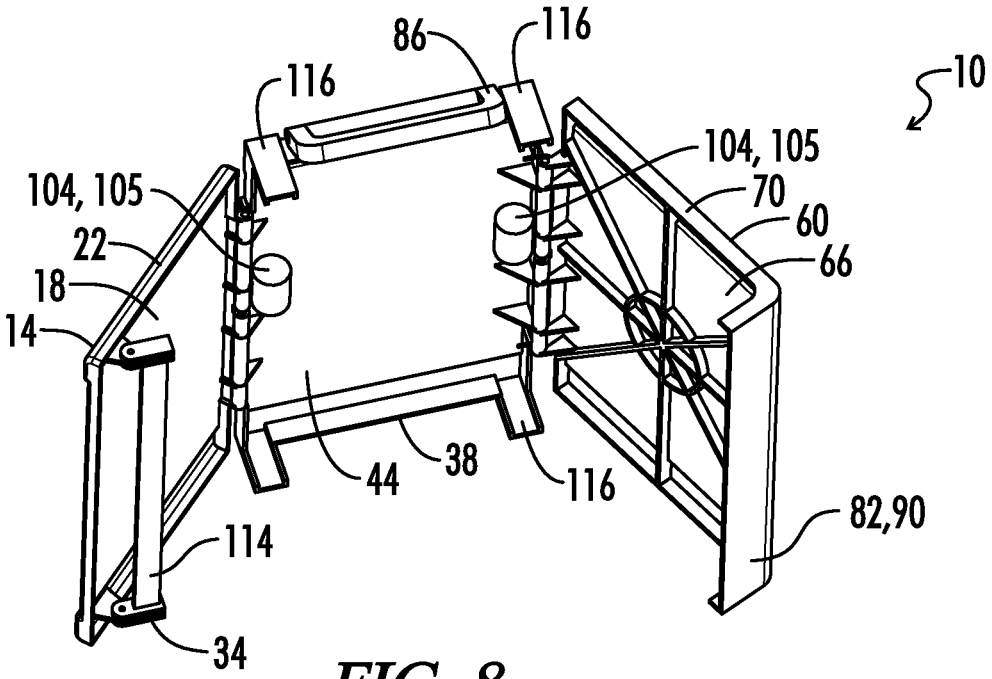
FIG. 8 illustrates a bottom, perspective view of the portable folding table of FIG. 1.
Figure 9:
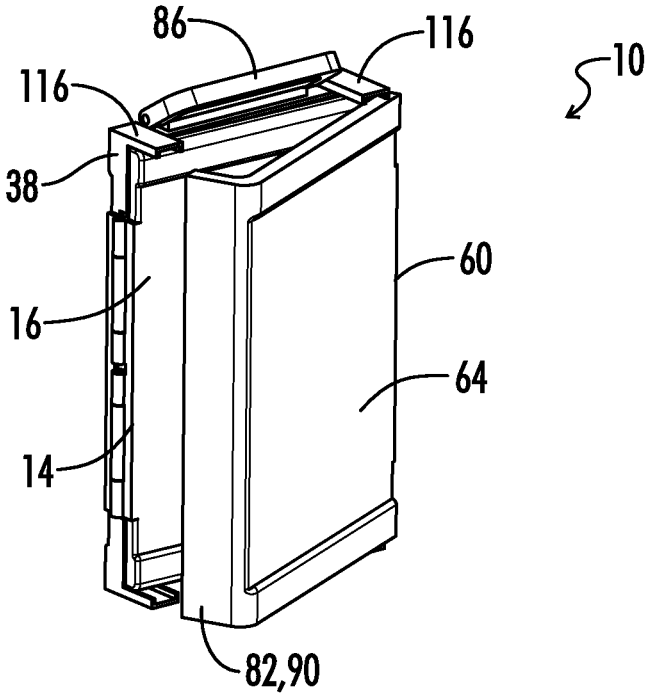
FIG. 9 illustrates a bottom, perspective view of the portable folding table of FIG. 1.
Figure 10:
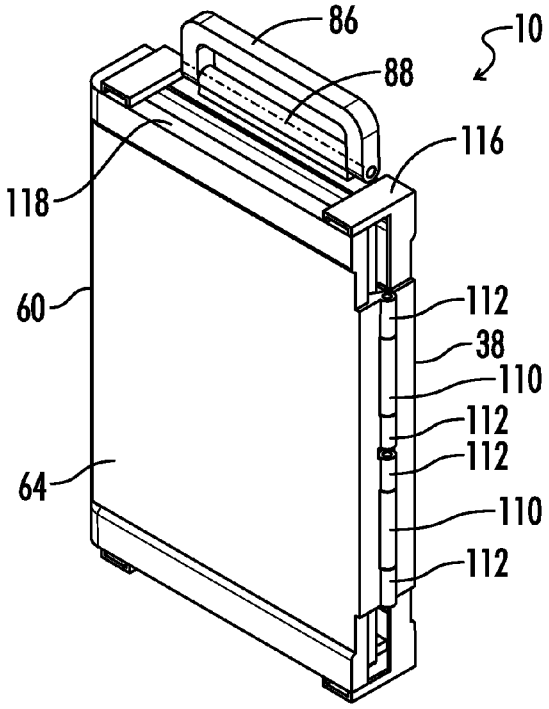
FIG. 10 illustrates a bottom, perspective view of the portable folding table of FIG. 1.
Figure 11:
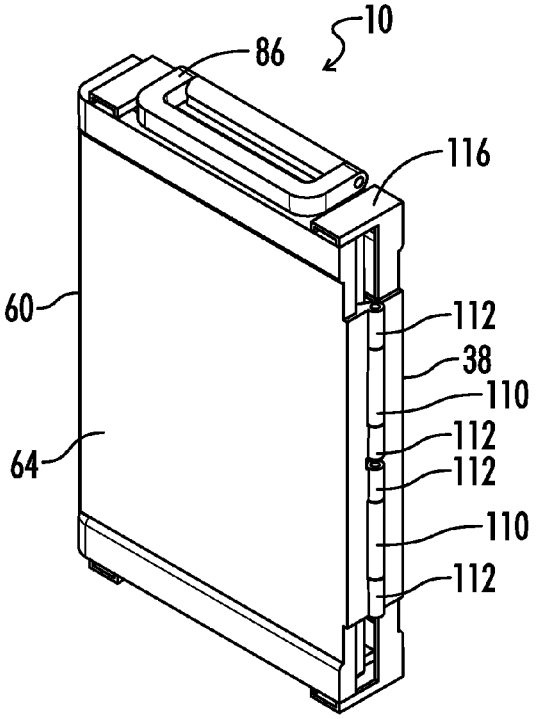
FIG. 11 illustrates a bottom, perspective view of the portable folding table of FIG. 1.
Figure 12:
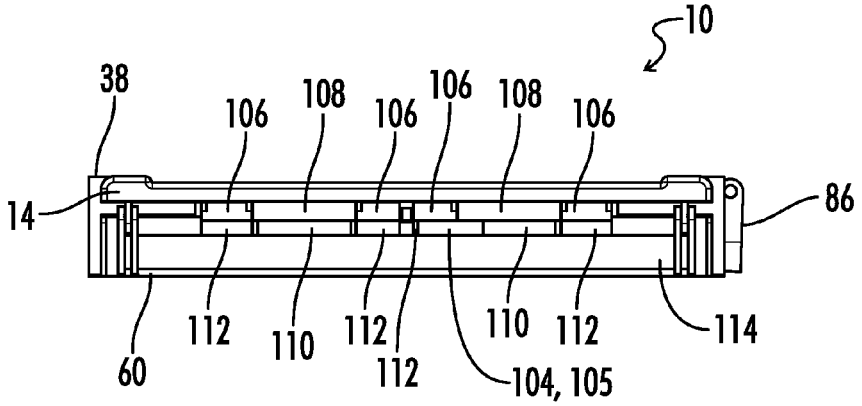
FIG. 12 illustrates a side, elevation view of the portable changing table of FIG. 1 in the collapsed position.

Optionally, as best seen in the sequential folding sequence illustrated in FIGS. 8-10 the portable changing table 10 is used in a method that includes:

a) providing the portable changing table 10 wherein the portable changing table 10 is in the extended position, wherein the handle 86 is located at the front 48 of the middle panel 38, wherein the right panel 60 further comprises a bottom flange 90 forming the leg 82 of the right panel 60, wherein the bottom flange 90 has a bottom flange width 92 generally parallel to the left panel width 26 and a bottom flange height 94 generally perpendicular to the bottom flange width 92, and further wherein the bottom flange height 94 is greater than or equal to the combined thickness of the middle panel 38 and the left panel 14;

b) folding the left panel 14 between about 90 and about 180 degrees relative to the middle panel 38 along the left pivot axis 40; and c) after step b, folding the right panel 60 between about 90 and about 180 degrees relative to the middle panel 38 along the right pivot axis 62.

The handle 86 is preferably located approximately at the length-wise center of the middle panel 38. The purpose behind the centrally-located handle 86 is that the table 10 can be placed generally upright, as shown in FIGS. 8-10, and easily folded and unfolded while holding the centrally-located handle 86. The inventors developed an alternate embodiment in which the handle 86 was on the right side 78 of the right panel 60 and the user held the table 10 vertically by this alternate handle 86 (with the right panel 60 above the middle panel 38 and the middle panel 38 above the left panel 14). In this alternate embodiment, the motors 104 were required to fight gravity when moving from the extended position to the collapsed position (i.e., the motors 104 were required to move the left panel 14 under the middle panel 38 and then move the left and middle panels 14 and 38 under the right panel 60), which required stronger motors 104. In the present case, the rear sides 24, 50, 72 of the left, middle and right panels 14, 38 and 60 are co-planar while folding (as shown in FIGS. 8-10) and can be supported by the ground while folding, eliminating the need to fight gravity. In addition, the present embodiment requires folding only one panel at a time (i.e., the left panel 14 is rotated relative to the middle panel 38 and then the right panel 60 is rotated relative to the middle panel 38), which requires less motor strength than the alternate embodiment, which moved two panels (the left and middle panels 14 and 38) under the right panel 60. It is desirable to use weaker motors 108, both due to cost and the safety hazards that accompany using a high torque motor to fold the table 10. Optionally, the motor 108 is a stepper motor.

Optionally, the left, middle and/or right panel bottom surfaces 18, 44 and 66 includes a lock (such as a solenoid pin, pull pin or motor driven lock) configured to releasably lock the table 10 in the extended position (i.e., to restrict rotation of the left panel 14 relative to the middle panel 38 and to restrict rotation of the right panel 60 relative to the middle panel 38), although such a lock is unnecessary when the legs 34, 82 and 116 are on a flat surface. Optionally, the lock is controlled by movement of the handle 86. Optionally, the left legs 34 include a lock configured to releasably lock the left legs 34 in the extended position.

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A portable changing table comprising:

a left panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface;

a middle panel pivotably attached to the left panel along a left pivot axis, the left pivot axis generally perpendicular to the left panel length and generally parallel to the left panel width, the middle panel comprising a top surface, a bottom surface, a thickness extending from the top surface to the bottom surface, a front side, a rear side, a width extending from the front side to the rear side, a left side, a right side, and a length extending from the left side to the right side; and a right panel pivotably attached to the middle panel along a right pivot axis, the right pivot axis generally perpendicular to the middle panel length and generally parallel to the middle panel width, the right panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface, wherein the portable changing table has an extended position in which the middle panel extends along the right side of the left panel and along the left side of the right panel and the top surface of the left panel is substantially co-planar with the top surface of the middle panel and the top surface of the right panel, wherein the portable changing table has a collapsed position in which the right panel bottom surface confronts the left panel top surface and the left panel bottom surface confronts the middle panel bottom surface, and wherein at least one of the front of the middle panel and the rear of the middle panel comprises a handle.

2. The portable changing table of claim 1, wherein the handle is configured to pivot from a storage position in which the handle is substantially co-planar with the middle panel thickness to an extended position in which the handle is substantially perpendicular to the middle panel thickness.

3. The portable changing table of claim 2, wherein the handle is configured to pivot along a handle pivot axis from the storage position to the extended position, the handle pivot axis generally parallel to the middle panel length.

4. The portable changing table of claim 2, wherein the middle panel further comprises a handle recess configured to store the handle when the handle is in the storage position.

5. The portable changing table of claim 1, wherein the portable changing table is configured to move from the extended position to the collapsed position by folding the right panel between about 90 degrees and about 180 degrees relative to the middle panel along the right pivot axis and folding the left panel between about 90 degrees and about 180 degrees relative to the middle panel along the left pivot axis.

6. The portable changing table of claim 1, wherein the handle is located at the front of the middle panel, wherein the right panel further comprises a bottom flange forming the at least one leg of the right panel, wherein the bottom flange has a bottom flange width generally parallel to the right panel width and a bottom flange height generally perpendicular to the right panel width, and further wherein the bottom flange height is at least as large as the combined thickness of the middle panel and the left panel.

7. The portable changing table of claim 1, wherein, in the extended position, the middle panel extends substantially the entire width of the left panel and substantially the entire width of the right panel.

8. The portable changing table of claim 7, wherein, in the extended position, the table further comprises a left front gap located between the front of the right side of the left panel and the front of the left side of the middle panel, a left rear gap located between the rear of the right side of the left panel and the rear of the left side of the middle panel, a right front gap located between the front of the left side of the right panel and the front of the right side of the middle panel, and a right rear gap located between the rear of the left side of the right panel and the rear of the right side of the middle panel.

9. The portable changing table of claim 1, wherein the left panel right side comprises a left panel flange extending towards the middle panel, wherein the middle panel left side comprises a middle panel left flange extending towards the left panel, wherein the left panel flange is attached to the middle panel left flange along the left pivot axis to create a left hinge, wherein the right panel left side comprises a right panel flange extending towards the middle panel, wherein the middle panel right side comprises a middle panel right flange extending towards the right panel, and further wherein the right panel flange is attached to the middle panel right flange along the right pivot axis to create a right hinge.

10. The portable changing table of claim 1, wherein the length of the left panel is substantially equal to the length of the middle panel and the length of the right panel.

11. The portable changing table of claim 1, wherein the legs each have a height generally parallel to the thicknesses of the left, middle and right panels, and further wherein the height of each leg is from about 3 inches to about 3 feet.

12. The portable changing table of claim 1 wherein the portable changing table has a length extending from the left panel left side to the right panel right side, and further wherein the length of the portable changing table is from about 3 feet to about 8 feet.

13. The portable changing table of claim 1, wherein the top surface of the left panel right side confronts the top surface of the middle panel left side in the extended position, wherein the confrontation of the top surface of the left panel right side and the top surface of the middle panel left side in the extended position is configured to prevent the portable changing table from moving from the extended position to an over-extended position in which the top surface of the left panel moves towards the top surface of the middle panel, wherein the top surface of the right panel left side confronts the top surface of the middle panel right side in the extended position, and wherein the confrontation of the top surface of the right panel left side and the top surface of the middle panel right side in the extended position is configured to prevent the portable changing table from moving from the extended position to an over-extended position in which the top surface of the right panel moves towards the top surface of the middle panel.

14. The portable table changing table of claim 1 wherein at least one of the legs is pivotally attached to a panel and is configured to pivot from a storage position in which the leg is substantially co-planar relative to the bottom surface of the panel to which the leg is pivotally attached to an extended position in which the leg is substantially perpendicular relative to the bottom surface of the panel to which the leg is pivotally attached.

15. The portable changing table of claim 1 wherein the left, middle and right panels are generally rectangular in shape.

16. A method of using a portable changing table comprising the steps of:

a) providing the portable changing table of claim 1 wherein the portable changing table is in the extended position; and b) placing a child on the top surfaces of at least one of the left panel, the middle panel and the right panel.

17. A method of using a portable changing table comprising the steps of:

a) providing the portable changing table of claim 1 wherein the portable changing table is in the extended position, wherein the handle is located at the front of the middle panel, wherein the right panel further comprises a bottom flange forming the at least one leg of the right panel, wherein the bottom flange has a bottom flange width generally parallel to the left panel width and a bottom flange height generally perpendicular to the bottom flange width, and further wherein the bottom flange height is approximately equal to the combined thickness of the middle panel and the left panel;

b) folding the left panel between about 90 degrees and about 180 degrees relative to the middle panel along the left pivot axis; and c) after step b, folding the right panel between about 90 degrees and about 180 degrees relative to the middle panel along the right pivot axis.

18. A portable changing table comprising:

a left panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface;

a middle panel pivotably attached to the left panel along a left pivot axis, the left pivot axis generally perpendicular to the left panel length and generally parallel to the left panel width, the middle panel comprising a bottom surface, a top surface, a thickness extending from the top surface to the bottom surface, a front side, a rear side, a width extending from the front side to the rear side, a left side, a right side, and a length extending from the left side to the right side; and a right panel pivotably attached to the middle panel along a right pivot axis, the right pivot axis generally perpendicular to the middle panel length and generally parallel to the middle panel width, the right panel comprising a top surface, a bottom surface, a thickness extending from the top surface to the bottom surface, a front side, a rear side, a width extending from the front side to the rear side, a left side, a right side, a length extending from the left side to the right side, and at least one leg extending from the bottom surface, wherein the portable changing table has an extended position in which the middle panel extends along the right side of the left panel and along the left side of the right panel and the top surface of the left panel is substantially co-planar with the top surface of the middle panel and the top surface of the right panel, wherein the portable changing table has a collapsed position in which the right panel bottom surface confronts the left panel top surface and the left panel bottom surface confronts the middle panel bottom surface, and further wherein one of the right panel and the left panel further comprises a bottom flange forming the at least one leg of the panel, wherein the bottom flange has a bottom flange width generally parallel to the panel's width and a bottom flange height generally perpendicular to the panel's width, and further wherein the bottom flange height is at least as large as the combined thickness of the other panels.

* * * * *